US005193674A

United States Patent [19]

Cobler et al.

[11] Patent Number: 5,193,674

[45] Date of Patent: Mar. 16, 1993

[54] CIGARETTE CARTON ASSEMBLY

[75] Inventors: Larry D. Cobler; George A. Shouse, both of Winston-Salem, N.C.

[73] Assignee: R. J. Reynolds Tobacco Company, Winston-Salem, N.C.

[21] Appl. No.: 764,259

[22] Filed: Sep. 23, 1991

[51] Int. Cl.[5] ..... B65D 85/10

[52] U.S. Cl. ..... 206/256; 206/273

[58] Field of Search ..... 206/256, 273, 491

[56] References Cited

U.S. PATENT DOCUMENTS

| | | | |
|---|---|---|---|
| 2,605,897 | 8/1952 | Rundle . | |
| 2,895,601 | 7/1959 | Krukonis . | |
| 3,071,244 | 1/1963 | Doran . | |
| 3,082,929 | 3/1963 | Aquino et al. . | |
| 3,086,650 | 4/1963 | Chapman et al. . | |
| 3,113,673 | 12/1963 | Stein . | |
| 3,163,351 | 12/1964 | Borgardt . | |
| 3,536,246 | 10/1970 | Rosen . | |
| 3,596,758 | 8/1971 | Phillips, Jr. et al. . | |
| 3,721,335 | 3/1973 | Grant . | |
| 3,752,308 | 8/1973 | Begemann . | |
| 3,809,227 | 5/1974 | Begemann . | |
| 4,050,579 | 9/1977 | Gorski et al. | 206/273 X |
| 4,631,900 | 12/1986 | Mattei et al. . | |
| 4,738,359 | 4/1988 | Phillips, Jr. . | |
| 4,928,817 | 5/1990 | Focke . | |
| 4,932,534 | 6/1990 | Focke et al. . | |

OTHER PUBLICATIONS

*Modern Packaging*, 5-Pack Cigarettes (1947).

*Primary Examiner*—William I. Price

[57] ABSTRACT

A cigarette carton assembly for 10 packages of cigarettes can be tax stamped using automated tax stamping machinery; and later divided into 2 half carton assemblies, each containing 5 packages of cigarettes. Each of the half carton assemblies have cigarette packages positioned therein in a 1 by 5 configuration. The carton assembly includes a collar which acts as a top portion of the carton assembly, and allows the carton assembly to be taxed stamped using automated tax stamping machinery. Then, the collar can be removed from the carton assembly, and the remaining carton assembly can be subdivided into two half carton assemblies.

4 Claims, 4 Drawing Sheets

CIGARETTE CARTON ASSEMBLY

BACKGROUND OF THE INVENTION

The present invention relates to the packaging of smoking articles such as cigarettes into cartons, and in particular, to the packing of packages of cigarettes into cartons such that the individual packages can be readily tax stamped.

It is common practice to ship and store cigarette packages in cartons. Conventional or standard cigarette cartons ordinarily hold ten packages, each package containing about 20 cigarettes. The packages are usually arranged in two relatively superposed rows of 5 packages each. Such standard cartons completely encase the cigarette packages and are provided with glued flaps. Examples of cartons for ten packages of cigarettes are provided in U.S. Pat. Nos. 3,752,308 to Begemann; 4,738,359 to Phillips, Jr.; and 4,903,844 to Oglesby.

Individual jurisdictions require the application of a tax stamp to each package of cigarettes sold in the respective jurisdiction. Typically, the distributor or jobber in the jurisdiction receives the cartons from the manufacturer, unseals the flap of carton which is sealed with a fugitive adhesive, applies the tax stamp to each package of cigarettes, and then recloses and reseals the carton. In order to minimize the time, labor and expense associated with tax stamping of the packages within the carton, various automated tax marking or stamping machines have been developed. Such tax marking machines automatically print or otherwise affix tax stamps to packages within the carton. Tax stamping machines which are most commonly employed by distributors and jobbers include ADCO Automatic Heat Transfer Decalomanic Stamping Machine which is available from American Decal & Mfg. Co., Chicago, Ill.; Cigarette Tax Stamp Applying Machine which is available from Meyercord, Carol Stream, Ill.; and Cigarette Tax Machine which is available from Pitney Bowes, Stamford, Conn. Accordingly, the dimensions and construction of the standard cigarette carton have been established by the tax stamping machinery customarily employed by the distributors, wholesalers and jobbers who tax mark the cigarette packages prior to retail sale.

A manufacturer desiring to provide cigarette packages in non-standard size or shape cartons is forced to pay to have the individual packages hand tax stamped. Alternatively, the manufacturer can package cigarette packages in standard cartons for tax stamping and handling, and then manually load the tax stamped packages into non-standard size or shape cartons. However, a manual method for providing non-standard size or shape cartons of packaged cigarettes is time consuming, laborious and expensive.

As disclosed in *Modern Packaging*, (1947) half carton packs are provided using a three sided paperboard collar and cellophane wrap such that the bottom of the cigarette packages are exposed for tax stamping. As disclosed in U.S. Pat. No. 4,738,359 to Phillips, Jr., cigarette packages can be contained in half cartons which can be tax stamped while in a master carton and later removed from the master carton for sale. Other methods for packaging cigarette packages into cartons which are divisible into smaller units are proposed in U.S. Pat. Nos. 3,809,227 to Begemann; 4,631,900 to Mattei, et al.,; 4,938,817 to Focke; and 4,932,534 to Focke, et al.

Occasionally, manufacturers desire to market cartons containing five packages of cigarettes. Such cartons are similar in design to the standard cartons, but only contain 1 row of 5 packages. However, such cartons have not achieved any appreciable commercial success. In particular, five package cartons having configuration comparable to standard cigarette cartons have had a top flap configuration. The particular top flap has required that the packages of such cartons be tax stamped by hand or that the tax stamped packages be manually loaded in the cartons.

It would be desirable to provide a manner or method for efficiently and effectively packaging cigarettes in divisible cartons (e.g., half cartons) which in turn are provided from standard size cartons of conventional shape or configuration. In particular, it would be desirable for the cigarette manufacturer to efficiently and effectively provide cigarette packages contained within standard cartons for tax stamping using conventional automatic or semi-automatic tax stamping machinery, which standard cartons have the capability of being divisible into half cartons.

SUMMARY OF THE INVENTION

The present invention relates to carton assemblies for packaged smoking articles (e.g., cigarettes). In particular, the invention relates to a carton assembly for 10 packages of cigarettes which are arranged therein (i.e., in a 2 by 5 configuration) for transport through and tax marking using a tax marking apparatus designed for tax marking the packages within a standard carton of conventional size and shape. The preferred carton has a top portion, a bottom portion, two end portions and two side portions. A "standard carton" assembly for 10 packages of cigarettes arranged in a 2 by 5 configuration is capable of being divided into smaller size cartons. Preferably, the standard carton assembly is capable of being divisible into 2 "half carton" assemblies each containing 5 packages preferably arranged in a 1 by 5 configuration.

In one aspect, the present invention relates to a standard carton assembly which includes 2 half carton assemblies which are attached together. In particular, a standard carton assembly for 10 packages of cigarettes is provided by combining two half carton assemblies for 5 packages of cigarettes using material which provides a portion of the standard carton assemblies as well as the half carton assemblies. Each of the half carton assemblies preferably have cigarette packages positioned therein in a 1 by 5 configuration. A collar means provides the top portion of the carton assembly or a portion of the top portion of the carton assembly. The collar means extends around the horizontal perimeter of the combined half carton assemblies, and provides a top portion to the carton assembly.

The collar means is removable, such that the half carton assemblies can be separated for further sales, distribution or use.

The present invention provides the manufacturer of smoking articles, such as cigarettes, with a method for packaging its product in carton assemblies which can be tax marked (e.g., using prints, decals, or the like) using conventional tax marking apparatus. Of particular interest is the fact that the divisible carton assemblies containing cigarettes can be assembled by the manufacturer, passed through tax stamping operations, and delivered to the retailer or consumer.

DETAILED DESCRIPTION OF THE PREFERRED EMBODIMENTS

Figure 1A:
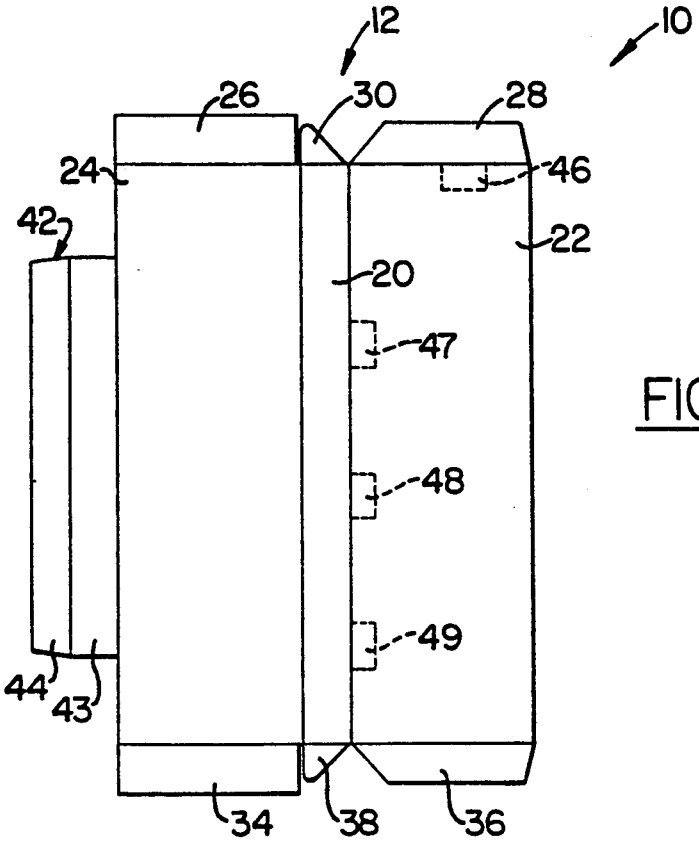
FIGS. 1A and 1B and 2A and 2B are top plan views of representative blanks (shown in approximate scale) for making certain carton assemblies of the present invention.
Figure 1B:
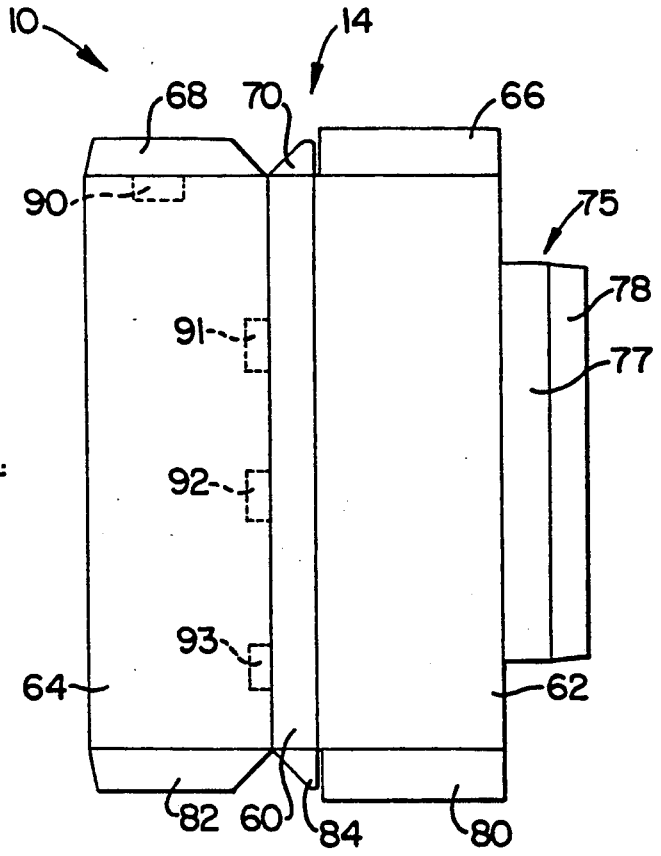

Referring to FIG. 1, blank assembly 10 includes two blank portions 12 and 14. Blank portions 12 and 14 are designed to form an assembled "standard" carton for 10 cigarette packages which can be separated into 2 "half carton" assemblies each containing 5 cigarette packages. Such blank portions are representative of blanks useful for constructing half carton assemblies, but other blanks and other half carton assembly configurations can be employed.

The blank portions 12 and 14 most preferably are provided from paperboard sheet, and include a plurality of fold lines, creases or score lines (shown as solid lines in FIG. 1); or perforations, cuts or slits (shown as dotted lines in FIG. 1). The degree of perforation can vary, and can be provided as to provide as desired. However, the degree of perforation is such that the joined half carton assemblies do not easily tear, and that the standard size carton can be handled as such. The cuts conveniently are made by slitting the blanks without necessarily removing material therefrom. The folds, perforations and cuts of the blank portions define panels which correspond to walls, portions, sides and flaps of the carton assemblies which ultimately are constructed from those blank portions.

Figure 2A:
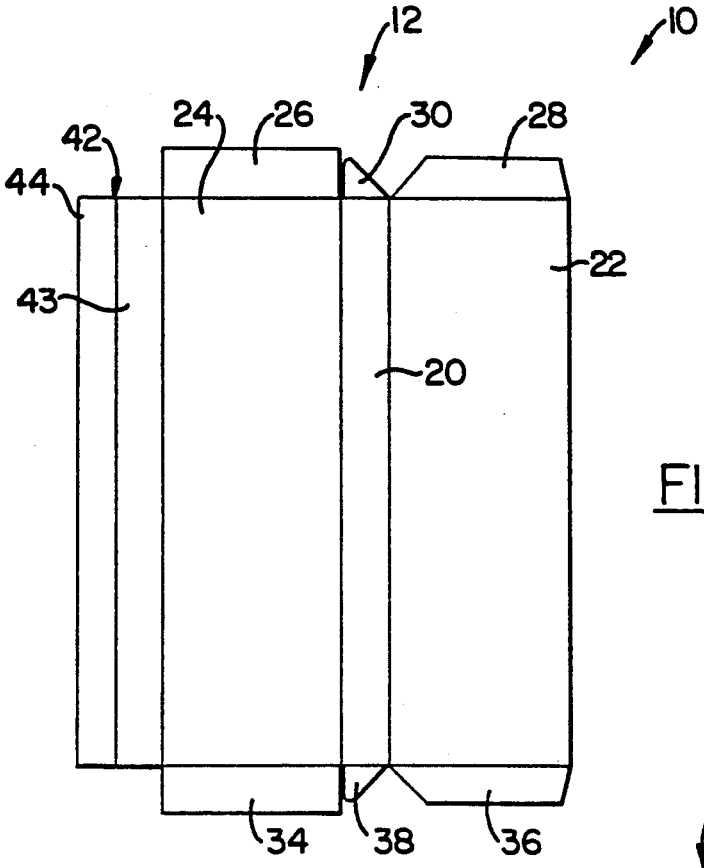
Figure 2B:
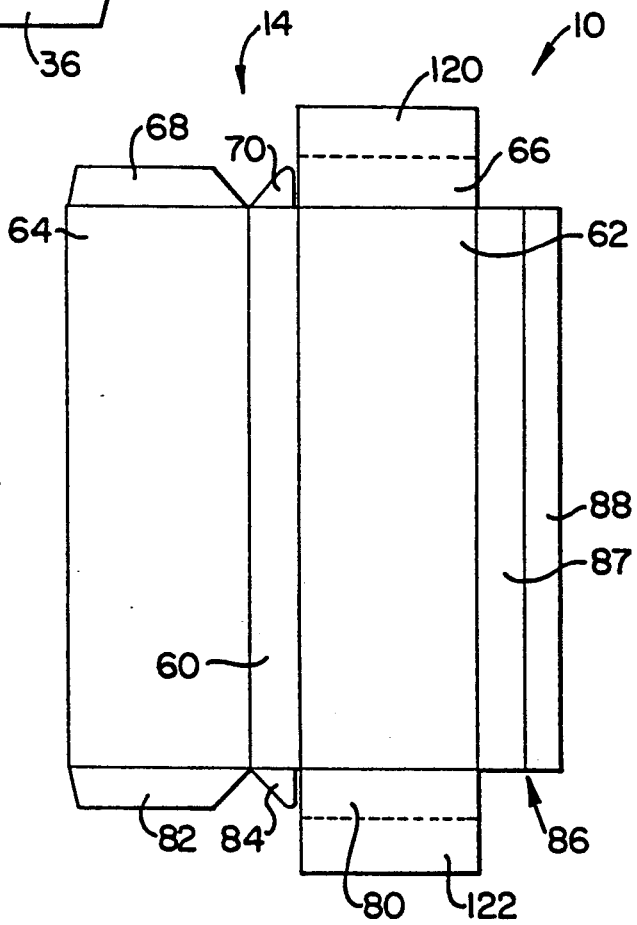

Blank portion 12 includes bottom portion 20 corresponding to the bottom of the carton assembly, a right side wall part 22, a left side wall part 24, and a first end wall part 26 positioned integral with and at one end of left side wall part 24. The length of left side wall part 24 is essentially equal to the width of five cigarette packages, the length of right side wall part 22 also is essentially equal to the width of five cigarette packages, the width of each of side wall parts 22 and 24 is equal to the height of a cigarette package, and the width of bottom portion 20 is essentially equal to the depth of one cigarette package. The blank portion 12 also includes a first end flap 28 integral with and at one end of right side wall part 24, and optional reinforcing tab or "dust flap" 30 integral with and at one end of bottom portion 20. The blank portion 12 includes a second end wall part 34 positioned integral with and at one end of left side wall part 24, a second end flap 36 integral with and at one end of right side wall part 22, and optional reinforcing tab 38 integral with and at one end of bottom portion 20. The blank portion 12 also includes top "tuck flap" 42 integral with and to one side of left side wall part 24. The tuck flap acts as the top portion of an assembled half carton. The tuck flap 42 shown in FIG. 1 does not extend along the entire length of the left side wall part; however, the tuck flap can extend along the entire length of that side wall part (as shown in FIG. 2). The tuck flap 42 includes an inner portion 43 having a width essentially equal to that of the depth of one cigarette package, and acts as a top wall of an assembled half carton; and outer portion 44 having a width essentially equal to that of the depth of one cigarette package, which acts as a tuck tab to maintain the assembled half carton in a closed position. The blank portion 12 also includes optional tear tabs 46, 47, 48 and 49, formed in right side wall part 22 by perforating, nicking or slitting selected regions of that side wall part.

Blank portion 14 is similar in many respects to the previously described blank portion 12, but is a mirror image of blank portion 12. Blank portion 14 includes bottom portion 60 corresponding to the bottom of the carton assembly, a right side wall part 62, a left side wall part 64, and a first end wall part 66 positioned integral with and at one end of right side wall part 62. The blank portion 14 also includes first end flap 68 integral with and at one end of left side wall part 64, and optional reinforcing tab or "dust flap" 70 integral with and at one end of bottom portion 60. The blank portion 14 also includes top "tuck flap" 75 integral with and to one side of right side wall part 62. Tuck flap 75 includes inner portion 77 and outer portion 78. The blank portion 14 also includes a second end part 80 integral with and at one end of right side wall part 62, a second end flap 82 integral with and at one end of left side wall part 64, and optional reinforcing tab 84 integral with and at one end of bottom portion 60. The blank portion 14 also includes optional tear tabs 90, 91, 92 and 93 formed in left side wall part 64 by perforating, nicking or slitting selected regions of that side wall part.

Blank portions 12 and 14 of FIG. 1 are designed to be assembled into half cartons for five packages of cigarettes each using known techniques; and to fit together and to be attached or secured together by applying adhesive to the outer surfaces of the tear tabs of the respective blank portions. As such, blanks 12 and 14 are erected into portions of the ultimate carton assembly by folding the blanks along the various fold lines; and the resulting half cartons are secured together into a standard carton assembly by adhesive at the regions where the tear tabs of the half cartons touch.

Referring to FIG. 2, alternate blank assembly 10 includes two blank portions 12 and 14, which are generally similar to those blank portions described with reference to FIG. 1. However, the blank portions shown in FIG. 2 do not require the tear tabs in the side wall parts 22 and 64 of the blank portions; but rather, blank portion 14 includes outer tab portions 120 and 122 integral with and at the ends of first end wall part 66 and second end wall part 80, respectively.

Blank portions 12 and 14 of FIG. 2 are designed to be assembled into half cartons for five packages of cigarettes each; and to fit together and to be secured together by applying adhesive to the inner surfaces of outer tab portions 120 and 122 of blank portion 14 and the outer surfaces of end wall parts 26 and 34, respectively, of blank portion 12.

Figure 3:
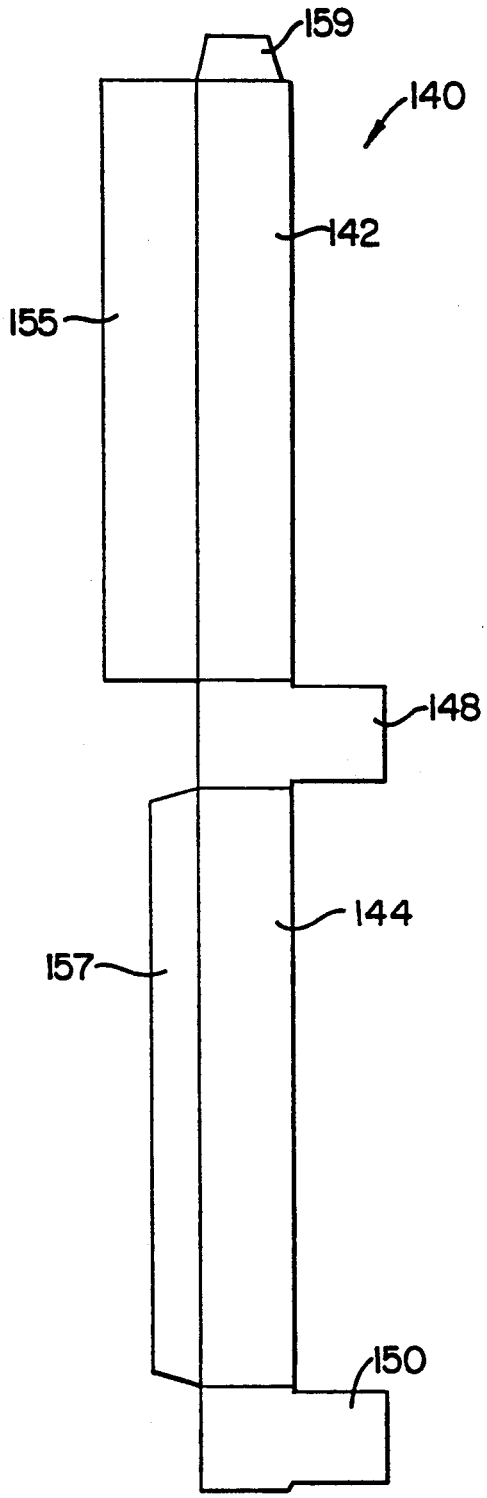
FIGS. 3 and 4 are top plan views of representative blanks (shown in approximate scale) for collar portions for certain carton assemblies of the present invention.

Referring to FIG. 3, there is shown blank portion 140 which is designed to form a collar for a standard carton for 10 cigarette packages. Blank portion 140 includes two side wall parts 142, 144 and two end wall parts 148, 150. The lengths of each of the side wall parts are essentially equal to the width of 5 cigarette packages, and the lengths of each of the end wall parts are essentially equal to the depth of two cigarette packages. The widths of the end wall parts 148, 150 are essentially equal to the height of one cigarette package. The widths of the side wall parts 142, 144 can vary, but are about ½ the width of the end wall parts 148, 150. Large top flap portion 155 is positioned integral with and at one side of side wall part 142; and small top flap portion 157 is positioned integral with and at one side of side wall part 144. The top flaps portions 155 and 157 provide for a configuration comparable to that of the top of a standard cigarette carton assembly known in the art (i.e., the width of top flap portion 155 is essentially equal to the depth of 2 cigarette packages, and the width of top flap portion 157 is less than that of top flap 155). Tab 159 is positioned integral with and at one end of side wall part 142. The collar is assembled in a rectangular shape by applying adhesive to the outer surface of tab 159 and securing that tab to inner surface of end wall part 150.

Figure 4:
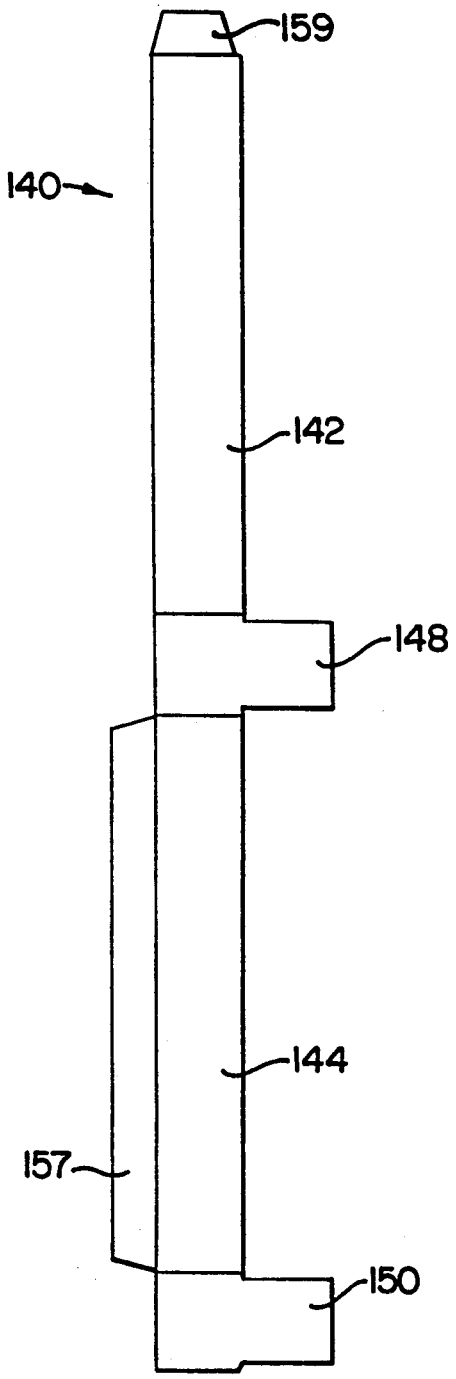

Referring to FIG. 4, alternate blank portion 140 is generally similar to the blank portion described with reference to FIG. 3. However, the blank portion shown in FIG. 4 does not include a large top flap positioned at one side of side wall part 142. Such a blank portion 140 is designed to form a collar to be employed with a standard carton assembly having a tuck flap (i) which extends along the entire length of the carton assembly, and (ii) which is comparable in size and shape to that of large top flap of a standard carton assembly. As such, the collar provides a portion of the top portion of the ultimate carton assembly.

Figure 5:
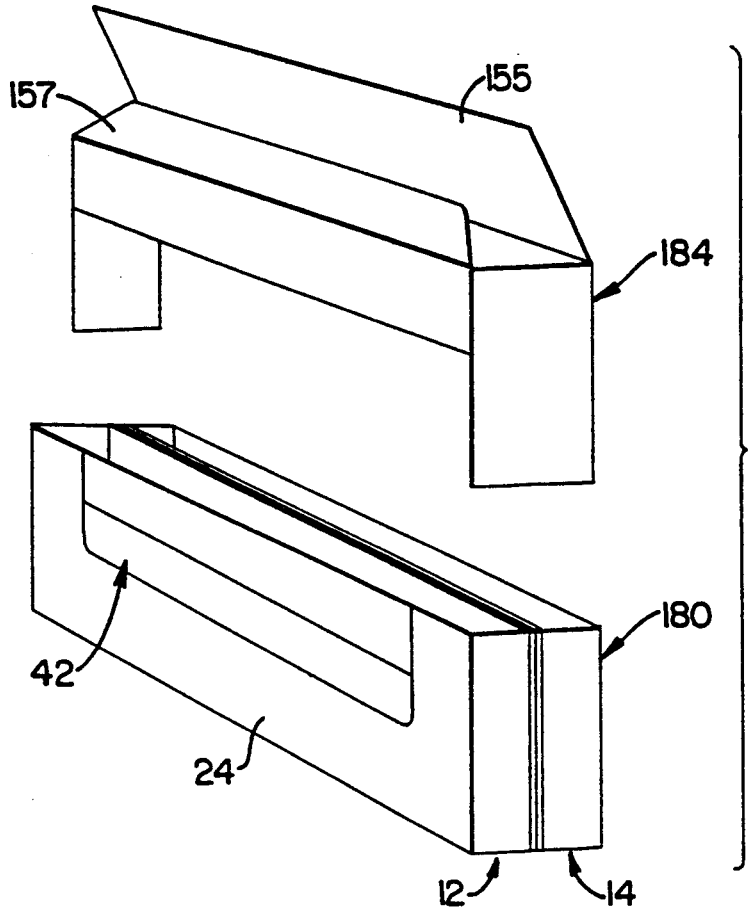
FIG. 5 is a perspective top view of a cigarette carton assembly for 10 cigarette packages and a collar portion for the carton assembly, the carton assembly shown in an unassembled configuration.
Figure 6:
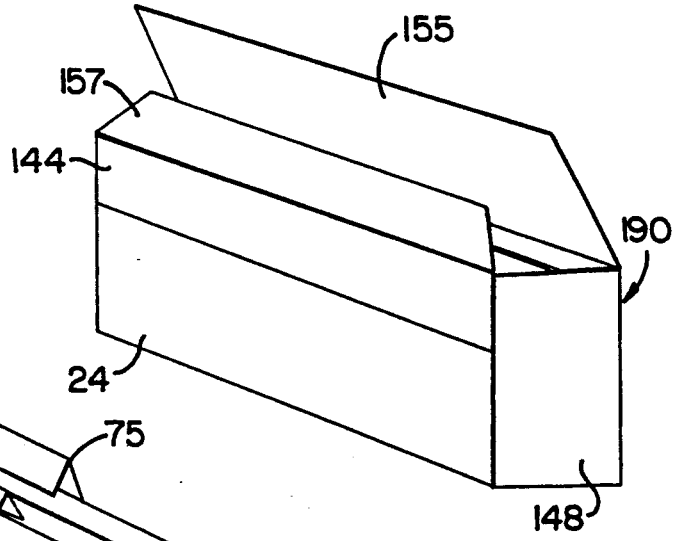
FIG. 6 is a perspective top view of an assembled cigarette carton assembly for 10 cigarette packages, the carton assembly shown in an open position.
Figure 7:
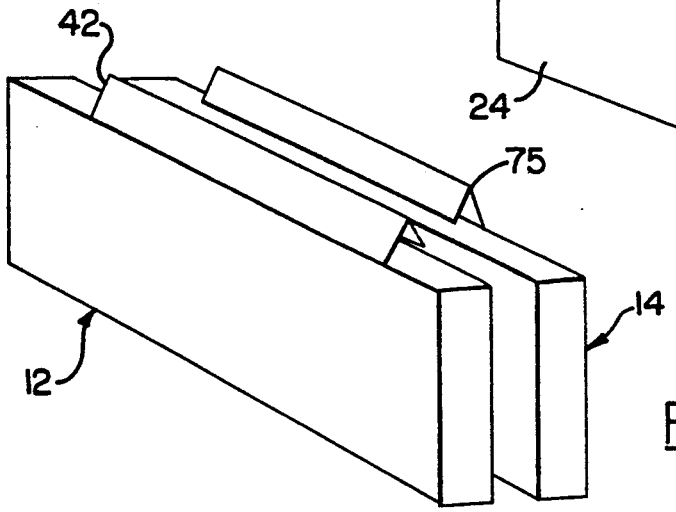
FIG. 7 is a perspective top view of two cigarette carton assemblies for 5 cigarette packages each, such assemblies shown in open positions.

Referring to FIG. 5, a 10 package cigarette carton assembly 180 is provided in a form in which cigarette packages therein (not shown) are arranged or positioned in a standard 2 by 5 configuration. That is, 5 packages are positioned side-by-side in a row on the right side of the standard carton assembly, and 5 packages are positioned side-by-side on the left side of the standard carton assembly. The carton assembly 180 includes 2 half carton assemblies of the type described with reference to FIG. 1, which are attached together. Collar means 184 is assembled from the blank described with reference to FIG. 3, and is positioned over the top of the carton assembly 180 and extends around the horizontal perimeter of the 2 half carton assemblies which are attached together. As such, the carton assembly 190 shown in FIG. 6 is provided. The top tuck flaps of the half carton assemblies are folded back so as to lie along the respective outer sides of the respective carton assemblies and are covered by the side walls of the collar means. The collar means is open at its bottom region. If desired, fugitive adhesive can be applied to the inner surfaces of the end wall parts of the collar means so as to maintain that collar means in place relative to the remaining portion of the carton assembly. The end wall parts of the collar means provide stabilization and support so that the collar means does not fall down over the remaining portion of the carton assembly. The side wall parts of the collar means extend over a portion of the height of the side walls of the remaining portion of the carton assembly so as to (i) require the use of a minimal amount of material by not requiring materials for significant portions of the side wall portions as well as a bottom portion, and (ii) completely cover the folded back tuck flaps of the half cartons. The top flaps 155 and 157 of the collar means can be sealed using fugitive glue as is common in the industry. Then, the cigarette packages contained in the carton assembly can be readily tax stamped using conventional automated techniques and equipment. The carton assembly then can be sealed for further shipping and handling. The carton assembly can be marketed as such (as shown in FIG. 6) or can be readily divided into two cigarette carton assemblies (each containing 5 packages), by removing the collar, discarding the collar, and breaking apart the two half carton assemblies (as shown in FIG. 7). That is, the standard carton assembly includes means for dividing that assembly into two half carton assemblies.

Cigarette packages can be inserted into the previously described assembled half carton assemblies, and the half carton assemblies containing cigarette packages then can be combined together into a standard carton assembly of conventional size and shape for tax stamping operations and commercial sale. Cigarette packages also can be inserted into a standard size assembly provided from two combined half carton assemblies, and then the carton assembly containing cigarettes can be subjected to tax stamping operations prior to commercial sale. The standard size carton assembly of the present invention behaves like a standard carton during tax stamping operations. The use of the collar means, which provides for a portion of the carton assembly, allows for the production of a useful standard size carton assembly while making efficient use of packaging materials. That is, as the collar may be discarded when two half carton assemblies are produced, the present invention does not require a collar having what would correspond to the bottom and significant amount of the side walls of a standard carton assembly. When the collar is removed from the remaining portion of the carton assembly, the tuck flaps of the half carton assemblies which were maintained in a folded back position by the collar, can be positioned over the top region of each respective half carton assembly to close each half carton assembly.

Referring to FIG. 7, two half carton assemblies 12 and 14 are shown as separated after the collar (not shown) has been removed from carton assembly and discarded or otherwise disposed of. That is, the adhesive seals at each of the tear tabs of the half carton assemblies are broken. The tuck flaps 42 and 75 are folded from along the respective sides of the carton assemblies to be positioned over the top region of each respective half carton assembly. As such, the half carton assemblies can be closed and opened in a known manner. It is also possible to seal the half carton assemblies using the tuck flaps prior to dividing the carton assembly into half cartons.

As used herein, the term "package" means a package comparable in size and shape to a conventional cigarette package which normally contains 20 cigarettes. See, for example, U.S. Pat. No. 4,852,734 to Allen, et al., and U.S. Pat. Application Ser. Nos. 525,737, filed May 17, 1990 and 717,456, filed Jun. 19, 1991. The package can be a soft package or a crush proof box. Generally, a package has a height of about 70 mm to about 100 mm, and most frequently 20 rod-shaped smoking articles each having a circumference of about 22 mm to about 25 mm are arranged therein in a so called "7-6-7" or "7-7-6" configuration.

As used herein, the term "standard carton assembly" means a conventional carton assembly which is capable of containing 2 rows of 5 cigarette packages, and which most preferably is capable of being passed through commonly employed automated tax stamping apparatus.

Generally, the length of a standard carton assembly is a minimum of about 266 mm and a maximum of about 286 mm. Generally, the width of a standard carton assembly ranges from about 40 mm to about 50 mm. Generally, the height of a standard carton assembly (when the top flaps are positioned such that the carton assembly is in a closed configuration) ranges from about 70 mm to about 100 mm.

An example of a preferred embodiment of this invention is as follows. A standard carton assembly has a length of about 270 mm, height of about 101 mm, width of 45 mm; and contains 10 packages of 20 cigarettes. The packages are arranged in 2 rows in a 1 by 5 fashion within the standard assembly carton. The carton assembly is manufactured from paperboard having a thickness of about 0.25 mm to about 0.30 mm. The carton assembly is provided from blank portions of the type shown in FIGS. 1 and 3.

The cigarette packages within the carton assembly of the present invention can be tax stamped using conventional tax stamping apparatus. The flaps of the carton assembly can be opened, the top (i.e., exposed) side of each of the cigarette packages therein can be stamped, and the carton assembly sealed, all without the necessity of removing or rearranging the cigarette packages. Thus, the half cartons (i.e., cartons which contain 5 packages of smoking articles) can be handled and processed by the jobber or wholesaler as are conventional or standard cartons containing 10 packages of cigarettes. When the carton assembly is available for retail sale, two half carton assemblies can be provided from the standard carton and handled as such. Thus, the cigarette manufacturer can efficiently and effectively provide an inexpensive multi-pack unit of smoking articles for sale. Additionally, the manufacturer can easily provide a means for displaying and merchandising unique multi-pack units of its products.

What is claimed is:

1. A carton assembly for 10 packages of smoking articles which are arranged in the carton assembly for transport through and marking using a tax marking apparatus designed for tax marking packages arranged within a standard carton, the carton assembly comprising:

i) top, bottom, side and end portions;

ii) two half carton assemblies, each capable of containing 5 packages of cigarettes; and iii) collar means for providing the top portion of the carton assembly.

2. The carton assembly of claim 1 containing 10 packages of cigarettes.

3. A carton assembly for 10 packages of smoking , articles which are arranged in a carton assembly for transport through and marking using a tax marking apparatus designed for tax marking packages arranged within a standard carton, the carton assembly comprising:

i) top, bottom, side and end portions;

ii) means for dividing the carton assembly into 2 half carton assemblies, each half carton assembly capable of containing 5 packages of cigarettes; and iii) collar means for providing a portion of the top portion of the carton assembly.

4. The carton assembly of claim 2 containing 10 packages of cigarettes.

* * * * *